United States Patent [19]

Hogan

[11] 4,273,094

[45] Jun. 16, 1981

[54] SLINGSHOT

[76] Inventor: Frank M. Hogan, 250 Sierra Vista, Tucson, Ariz. 85731

[21] Appl. No.: 79,340

[22] Filed: Sep. 27, 1979

Related U.S. Application Data

[63] Continuation of Ser. No. 839,215, Oct. 3, 1977, abandoned.

[51] Int. Cl.[3] ..... F41B 7/00

[52] U.S. Cl. ..... 124/20 R

[58] Field of Search ..... 124/20 R, 17, 21, 22, 124/35 R, 41 A; 33/265

[56] References Cited

U.S. PATENT DOCUMENTS

| | | | |
|---|---|---|---|
| 2,600,524 | 6/1952 | Fernsel | 124/20 R |
| 3,494,346 | 2/1975 | Yount et al. | 124/20 R |
| 3,865,094 | 2/1975 | Sweeney | 124/20 R |

*Primary Examiner*—William R. Browne

*Attorney, Agent, or Firm*—Rummler & Snow

[57] ABSTRACT

A device for propelling a missile toward an object. Said device includes a handle frame having upwardly and rearwardly divergently disposed, bowed arms and a pair of rubber tubes each slidably mounted on a tube carrying arcuate member integrally formed medially on and positioned above the upper end of the handle, the free portions spaced above each of the arms on which a rubber tube is slidable thereon, and a sight integrally formed on the upper end of the handle.

4 Claims, 5 Drawing Figures

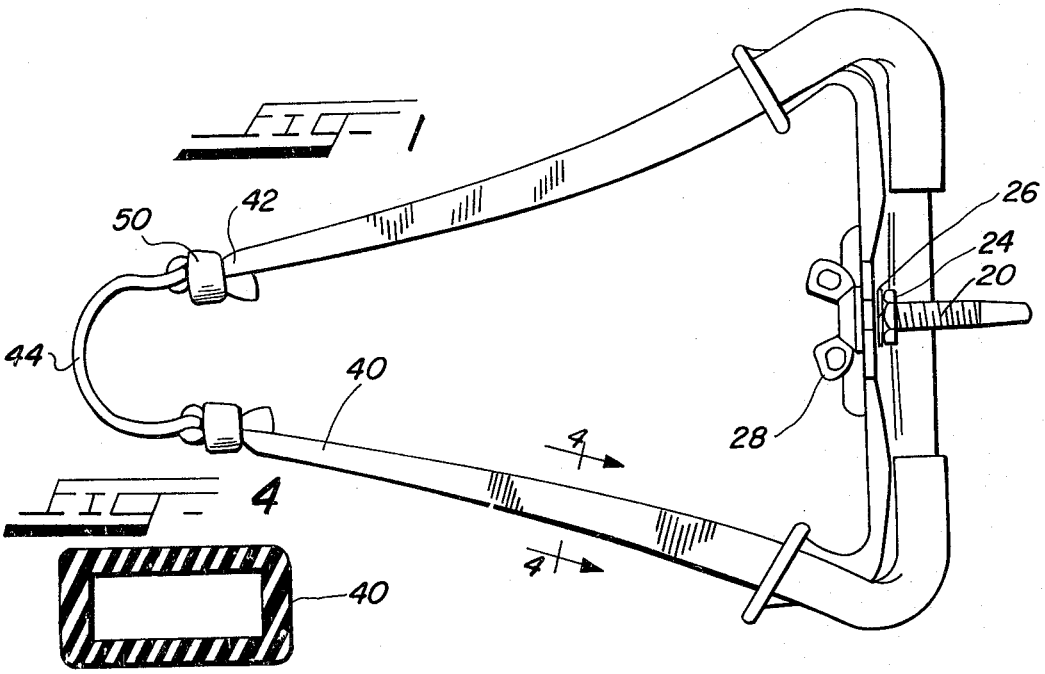
FIG- 1
50
42
26
24
20
44
40
28
4
4
FIG- 4
40
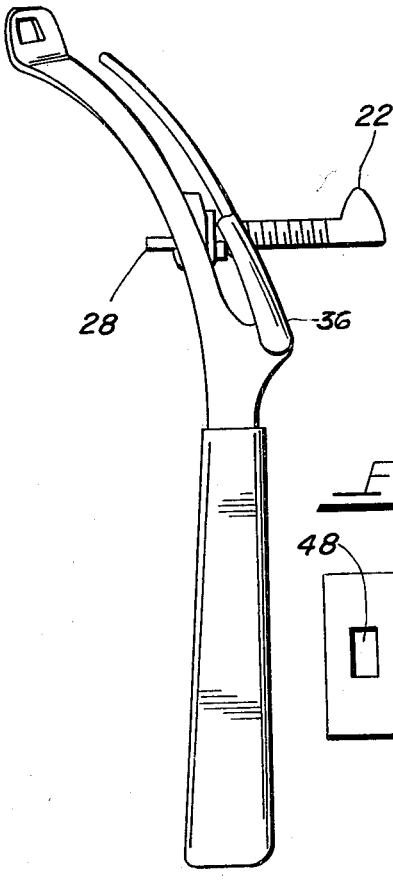
FIG- 2
22
28
36
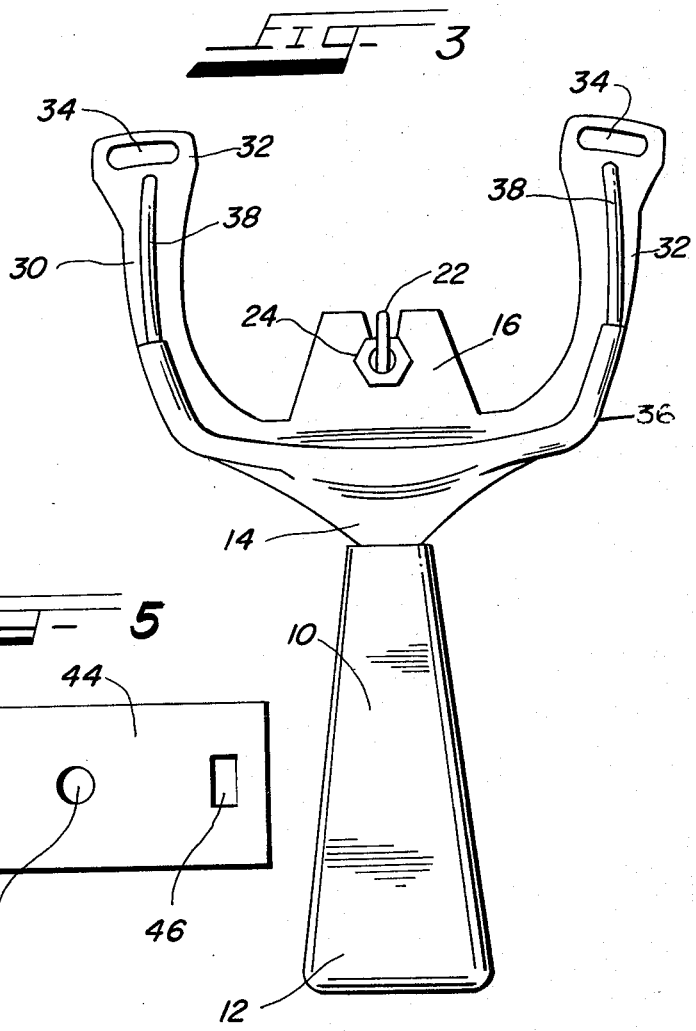
FIG- 3
34
34
32
38
38
32
30
22
24
16
36
14
10
12
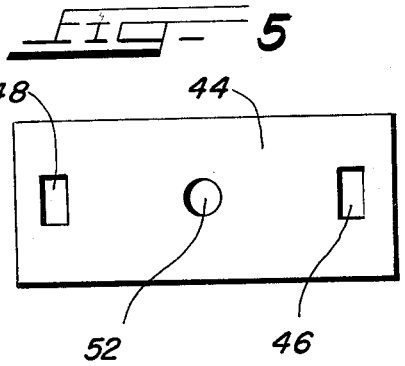
FIG- 5
48
44
52
46

SLINGSHOT

BACKGROUND OF THE INVENTION

This invention was shown in the application filed Oct. 3, 1977, in the United States Patent and Trademark Office, and bearing the Ser. No. 839,215 (now abandoned), and this is a continuation thereof.

SUMMARY OF THE INVENTION

A handle having an integrally formed pair of bowed arms with the free ends bent outwardly and upwardly and each terminating in a rectangular perforation bent angularly, a sight between the arms and adjacent the upper end of the handle, an integrally formed member positioned on the upper end of the handle and spaced therefrom having outwardly and upwardly extending arms generally conforming to the configuration of the bowed arms, a pair of rectangularly shaped, in cross-section, tubular members threaded one through each of the respective perforations and slidable on said connecting members, and the other ends of said tubular members each connected to a projectile holder.

BRIEF DESCRIPTION OF THE DRAWINGS

FIG. 1 is a top elevational view of the device;

FIG. 2 is an end elevational view taken on lines 2—2 of FIG. 1 with tube removed;

FIG. 3 is a rear elevational view of the device of FIG. 1;

FIG. 4 is an enlarged cross-sectional view taken on line 4—4 of FIG. 1; and FIG. 5 is a plan view of the leather missile carrier.

DETAILED DESCRIPTION OF THE DRAWINGS

All reference to directions is as shown in the drawings.

The slingshot of the present invention comprises a tapered handle 10 with the lower end 12 being the widest part for sure gripping.

Integrally formed on the upper end 14 is a generally triangularly shaped sight 16 having a V-shaped cutout 18 formed in the apex thereof. An aperture is drilled just below the V-cut to receive a threaded rod 20, on one end of which is formed a blade 22 whereby a sighting may be had using the V-slot 18 and the blade 22 for aiming, the rod being provided with a nut 24, a split washer 26 on one side of the sight 16 and a wingnut 28 on the other side to anchor the blade 22 in proper position and in alignment with cutout 18, as shown in the drawing.

The bowed legs 30, 32 are each integrally formed on the upper end of the handle 10 and each extends upwardly and inwardly arcuately, terminating in an angularly disposed flattened portion 32 having a rectangular aperture 34 incorporated therein all in a smooth transition. Each of the flattened portions is disposed angularly outwardly from each other at about 130 degrees from the vertical centerline of the handle.

Also integrally formed medially on the upper end of the handle and below the sight is a tube 36 which extends above and outwardly in both directions from the centerline of the handle in a small radius and then is bent outwardly and upwardly in a greater radius so that the tube will lie above the legs 30, 32. A smaller elongated rod is anchored medially in the tube 36 and extends outwardly thereof in both directions and lies above the legs 30, 32 and has a small radius. The free ends of the rods 38 terminate above and adjacent the lower ends of the perforations 34.

A pair of rectangularly shaped rubber or other elastic tubes 40, 42, preferably of a length of about $9\frac{7}{8}$ inches, are inserted one through each of said openings 34 and on the rods 38 and tubes 36 up to the point of attachment to the handle 10.

The free ends of the tubes 40, 42 are anchored to a piece of soft pliable leather 44, or other material, generally of elongated rectangular shape. See FIG. 5. Each end of the leather is provided with perforations 46, 48. One end of the rubber member 40 is inserted in the opening 46 and bent over itself. A small piece of tubing 50 is stretched over the bent-over portion and the adjacent portion of tube 10 thus anchoring the tube 40 to one end of the leather 44. The tube 42 is attached to the opposite end of the leather in the same manner.

A small perforation 52 is centered in the leather 44.

In operation, a missile is placed in the inside of the leather 44, the handle 10 is grasped by one hand and the other on the outer side of the leather and pulled rearwardly away from the legs 30, 32. The eye of the person using the device lines up his target through the V in the sight and the blade. When lined up properly, the hand holding the leather releases it and the missle is projected.

Athough but one specific embodiment of this invention is herein shown and described, it will be understood that details of the construction shown may be altered or omitted without departing from the spirit of the invention as defined by the following claims.

I claim:

1. In a slingshot, a substantially heavy handle tapering upwardly from the base, a sight tapering upwardly from the upper end of the handle, a V-groove in the upper medial end of the sight, an aperture below the V-groove, a forwardly extending, horizontal rod in said aperture and secured thereto, a blade on the forward end of said rod and aligned with said V-slot, a pair of legs integrally formed on the upper end of said handle each extending upwardly and rearwardly and radially and terminating in a flattened portion, said flattened portion bent at an angle, a rectangular opening in each of said flattened portions, a tube integrally secured to the upper end of said handle and spaced away therefrom and positioned on the front of said device, said tube extending outwardly in opposite directions from said point of securement with the free ends being bent upwardly radially, a rod anchored medially in said tube and extending outwardly of said tube in opposite directions and both ends bent at a radius towards said arms and each terminating below and adjacent said rectangular opening, a pair of rubber tubes, one end of each rubber tube inserted through the rectangular openings and slidable on the rods and the integral tube, a soft, resilient, rectangular shaped piece of leather, apertures in each end of said leather, the free end of said tubes inserted in and through one of each of said apertures and bent over itself, and means for anchoring said bent-over portions of said tube.

2. The device according to claim 1 wherein said horizontal rod extends forwardly of said notch is threaded and the portion extending through said aperture is secured by nuts.

3. The device according to claim 2 wherein the rubber tubes are rectangularly shaped and the apertures in the leather are also rectangularly shaped.

4. The device according to claim 3 wherein the anchoring means for the bent-over portions of the tube is a piece of elastic.

* * * * *